US011826811B1

(12) United States Patent
Luo

(10) Patent No.: US 11,826,811 B1
(45) Date of Patent: Nov. 28, 2023

(54) IRREGULAR TUBE STRAIGHTENER

(71) Applicant: Guofen Luo, Dongguan (CN)

(72) Inventor: Guofen Luo, Dongguan (CN)

( * ) Notice: Subject to any disclaimer, the term of this patent is extended or adjusted under 35 U.S.C. 154(b) by 0 days.

(21) Appl. No.: 17/859,019

(22) Filed: Jul. 7, 2022

(51) Int. Cl.
*B21D 3/04* (2006.01)
*B21D 3/16* (2006.01)

(52) U.S. Cl.
CPC ..... *B21D 3/045* (2013.01); *B21D 3/16* (2013.01)

(58) Field of Classification Search
CPC ... B21D 3/16; B21D 3/02; B21D 3/04; B21D 3/045; B21D 1/02
See application file for complete search history.

(56) References Cited

U.S. PATENT DOCUMENTS 748,745 A * 1/1904 Josserand et al. ..... B21D 3/04 72/100
1,649,706 A * 11/1927 Kelley ..... B21D 1/02 72/12.8
2,153,811 A * 4/1939 Montgomery ..... B21D 1/02 72/46
2004/0050131 A1* 3/2004 Militaru ..... B21D 3/04 72/162

* cited by examiner

*Primary Examiner* — Teresa M Ekiert

(57) ABSTRACT

An irregular tube straightener is disclosed, which comprises a machine frame, upper and lower pulley blocks which are configured on the front side of the machine frame and work together to reshape the irregular tube, and an adjusting device mounted on the machine frame and used to adjust the size of the gap between the upper pulley block and the lower pulley block. The adjusting device comprises an adjusting screw rod mounted on the machine frame, a handle fixed on the upper end of the adjusting screw rod, a lifting and lowering seat configured on the back side of the machine frame, and a threaded bushing fixed inside the lifting and lowering seat. The threaded section on the lower end of the adjusting screw rod is spirally fitted inside the threaded bushing. The upper pulley block comprises at least two upper pulleys.

10 Claims, 6 Drawing Sheets

IRREGULAR TUBE STRAIGHTENER

BACKGROUND OF INVENTION

1. Field of the Invention

The present invention relates generally to a technique for straightening and reshaping tubes, and more particularly to an irregular tube straightener.

2. Description of Related Art

Tubular materials (e.g., copper tubes) are transported and sold directly in the form of long tubes. Because the material of copper tubes is relatively soft, the long tubes may be twisted or curved easily during translation or due to external forces. The twisted or curved copper tubes will directly affect the quality of the processed components. Therefore, before processing, the twisted or curved copper tubes must be straightened in order to produce standard and high-quality components.

Furthermore, tubular materials in rolls also need to be straightened by using a machine or device similar to a mixer to pull the two ends of the tube. However, this method costs a lot of electricity and is very complicated. The operation requires a sufficient space and may easily result in certain quantity of waste, which affects the use rate of the tubular material.

In particular, when it comes to straightening an irregular tube, the operation is extremely difficult and inconvenient. The difficulty in straightening irregular tubes using the existing machines are really frustrating for workers.

In view of this, the inventor has provided the following technical solution.

SUMMARY OF THE INVENTION

The purpose of the present invention is to overcome the deficiencies of the prior art and provide an irregular-shaped pipe straightener.

In order to solve the above-mentioned technical problems, the present invention adopts the following technical solutions:

An irregular tube straightener, comprises a machine frame configured on the front side of the machine frame, an upper pulley block and a lower pulley block that work together to reshape the irregular tube, and an adjusting device mounted on the machine frame to adjust the size of a gap between the upper pulley block and the lower pulley block, wherein the adjusting device includes an adjusting screw rod mounted on the machine frame in a rotary form, a handle fixed on an upper end of the adjusting screw rod, a lifting and lowering seat configured on a back side of the machine frame, and a threaded bushing fixed inside the lifting and lowering seat, a threaded section on a lower end of the adjusting screw rod is screwed inside the threaded bushing, the upper pulley block includes at least two upper pulleys, the upper pulley is configured with a first bearing, the first bearing is fixed with a first rivet, the first rivet goes through a vertical slide opening configured on the machine frame and is fixed on a front face of the lifting and lowering seat, so that the upper pulley is mounted on the lifting and lowering seat.

More particularly, wherein said lower pulley block includes at least two lower pulleys the lower pulley is configured with two third bearings, the two third bearings are fitted with second rivets, and the second rivets are riveted on the front face of the machine frame.

More particularly, wherein the end of the second rivet riveted on the machine frame is configured as a polygonal structure.

More particularly, wherein the periphery of the upper pulley is configured with a concave first groove used to contact with the irregular tube, the periphery of the lower pulley is configured with a concave second groove used to contact with the irregular tube, and the second groove is located below the first groove.

More particularly, wherein the first groove and the second groove are both in the shape of V or U.

More particularly, wherein the adjusting device also includes a bearing seat fixed on the upper end of the machine frame and a second bearing mounted inside the bearing seat, the unthreaded rod section on the upper end of the adjusting screw rod goes through the sleeve bushing and is fixed inside the through hole of the second bearing, the unthreaded rod section is extended out of the upper end face of the bearing seat, and the handle is fixed on the upper end of the unthreaded rod section.

More particularly, wherein the lower end of the handle is configured with a mounting slot, the handle is fitted on the upper end of the unthreaded rod section through the mounting slot, and the outside of the lower end of the handle is configured with a screw hole that is communicated to the mounting slot, the screw hole is spirally fitted with a worm screw, and the end portion of the worm screw is embedded into the positioning slot configured on the periphery of the upper end of the unthreaded rod section.

More particularly, wherein the machine frame comprises a vertical board and a top board formed through 90-degree folding on one side of the upper end of the vertical board, the adjusting device is configured on the top board, and the handle is exposed on the upper end of the top board.

More particularly, wherein the junction between the top board and the vertical board is integrally formed with reinforcing ribs to increase the strength, and the surface of the vertical board is stamped with bar-shaped convex ribs to increase the strength.

More particularly, wherein the two sides of the lower end of the vertical board are respectively configured with symmetrically distributed first L frame and second L frame.

Comparing with the prior art, the present invention provides the following advantages:

The present invention uses an upper pulley block and a lower pulley block to clamp the irregular tube that goes through the gap between the upper pulley block and the lower pulley block, so as to reshape the irregular tube. By turning the handle in the adjusting device, the size of the gap between the upper pulley block and the lower pulley block can be adjusted. The operation is very convenient. A simple structure means low production cost, and a small overall size means easy transportation. Therefore, the invention will be very competitive in the market.

DETAILED DESCRIPTION OF THE INVENTION

Figure 1:
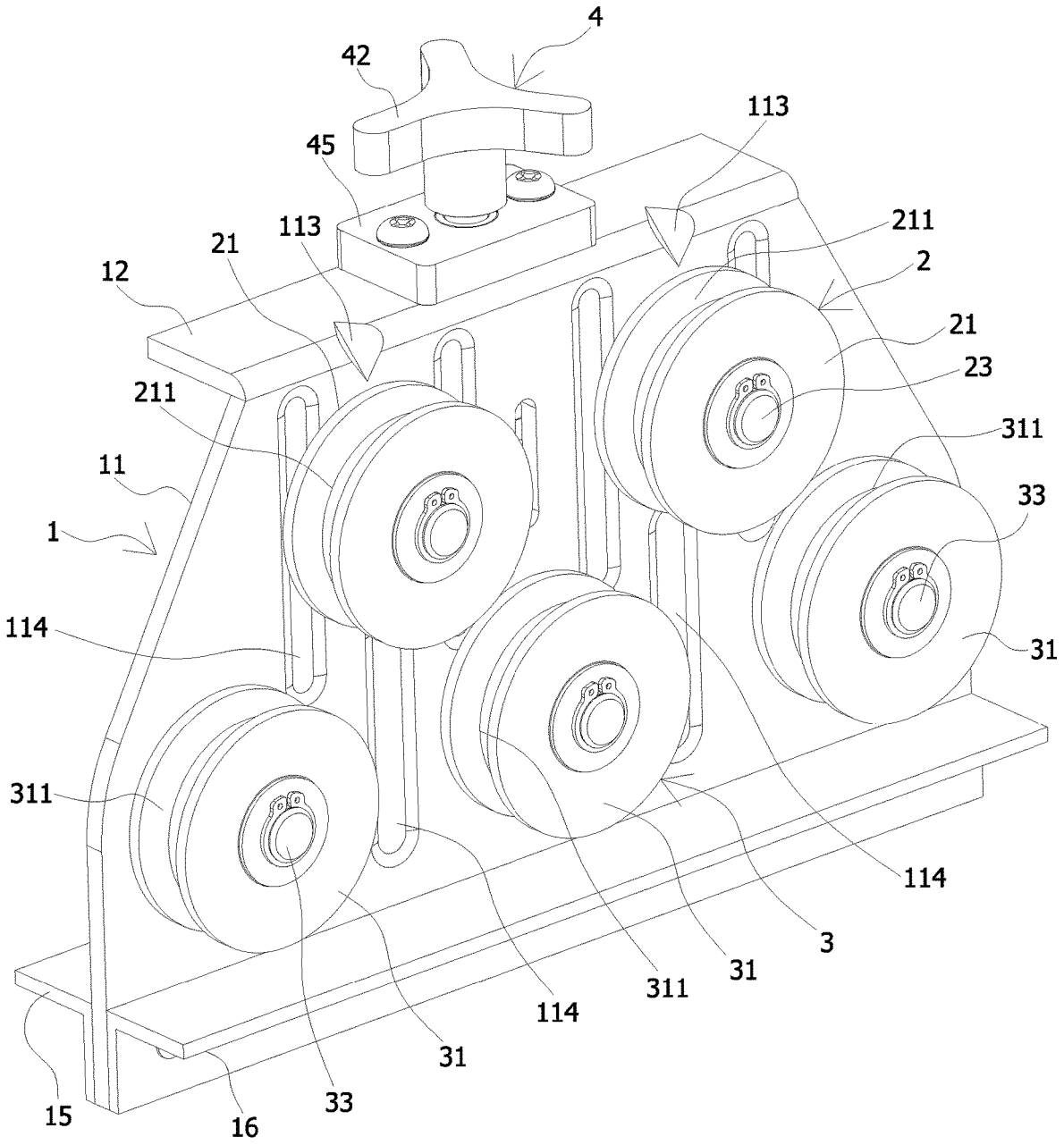
FIG. 1 is a perspective view of the present invention.
Figure 2:
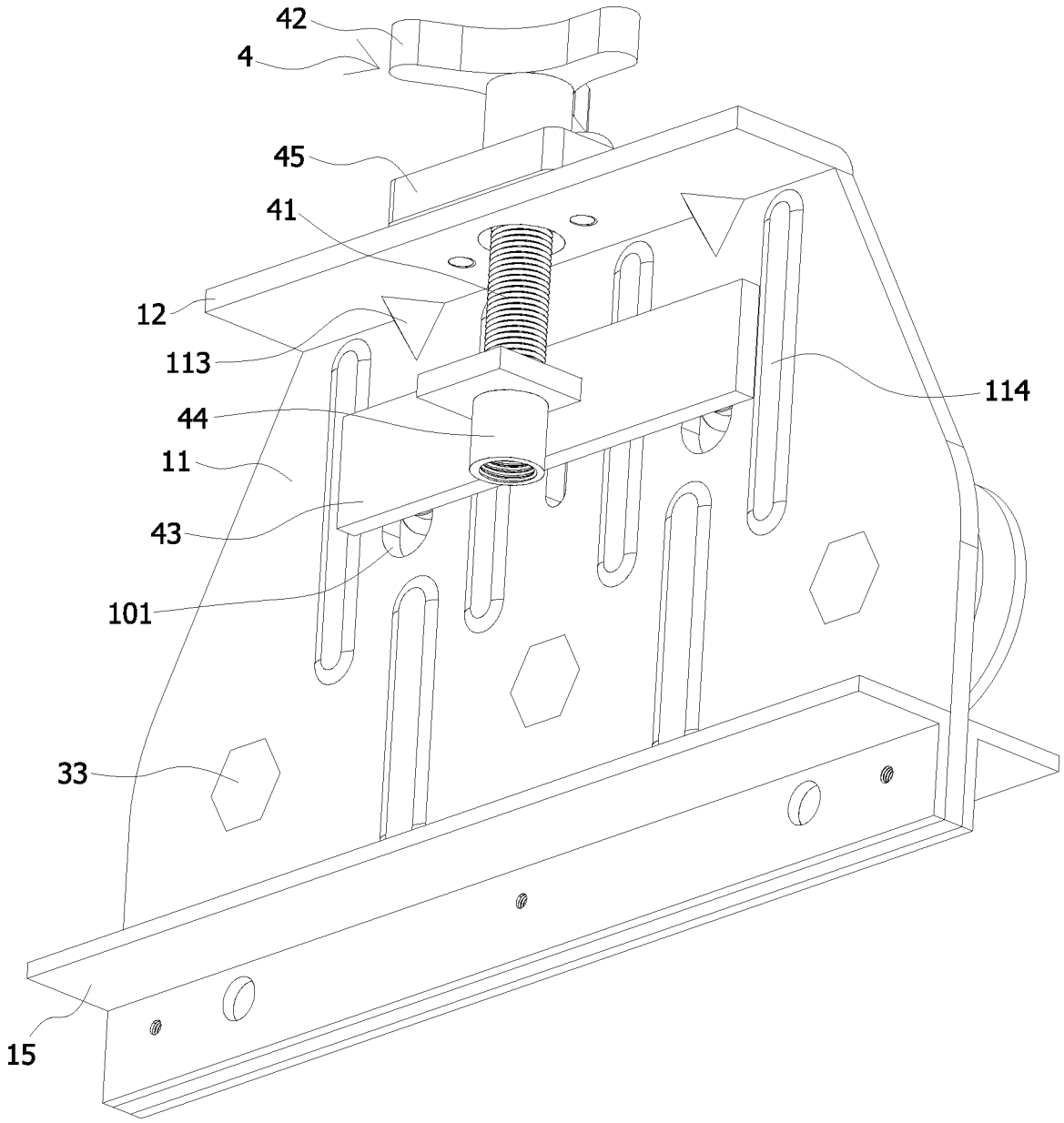
FIG. 2 is a perspective view of the present invention from another angle.
Figure 3:
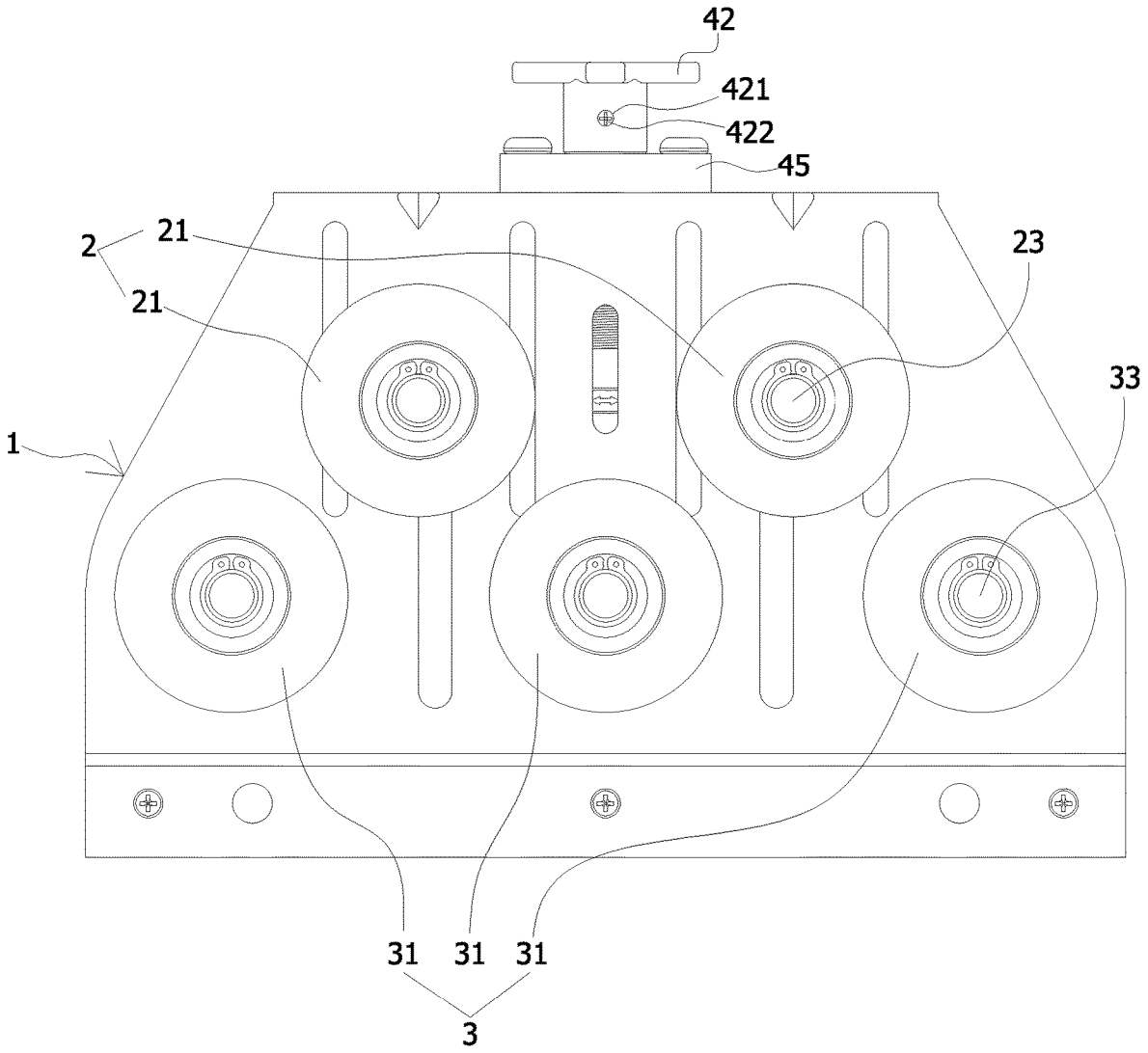
FIG. 3 is a front view of the present invention.
Figure 4:
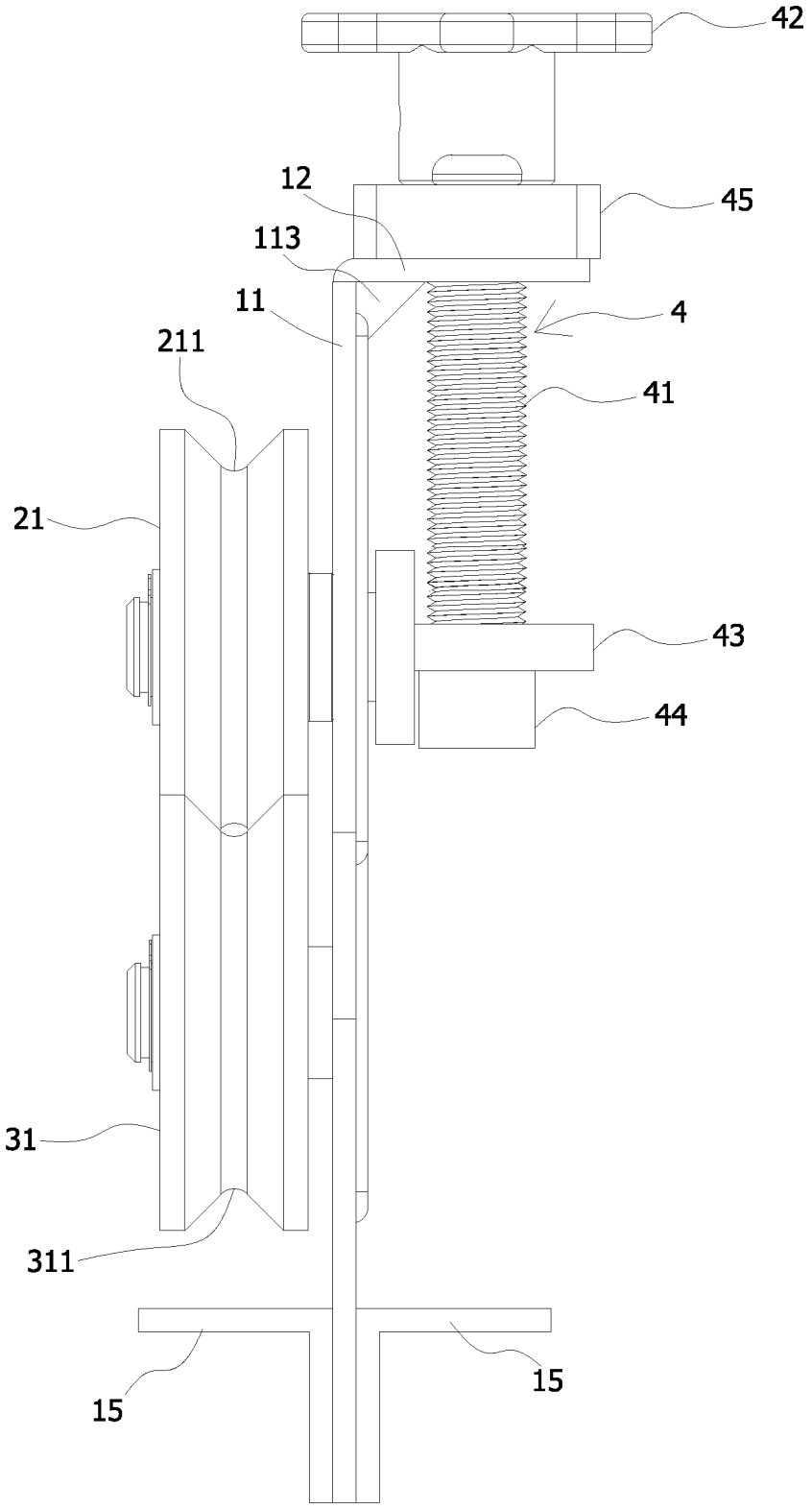
FIG. 4 is a right view of the present invention.
Figure 5:
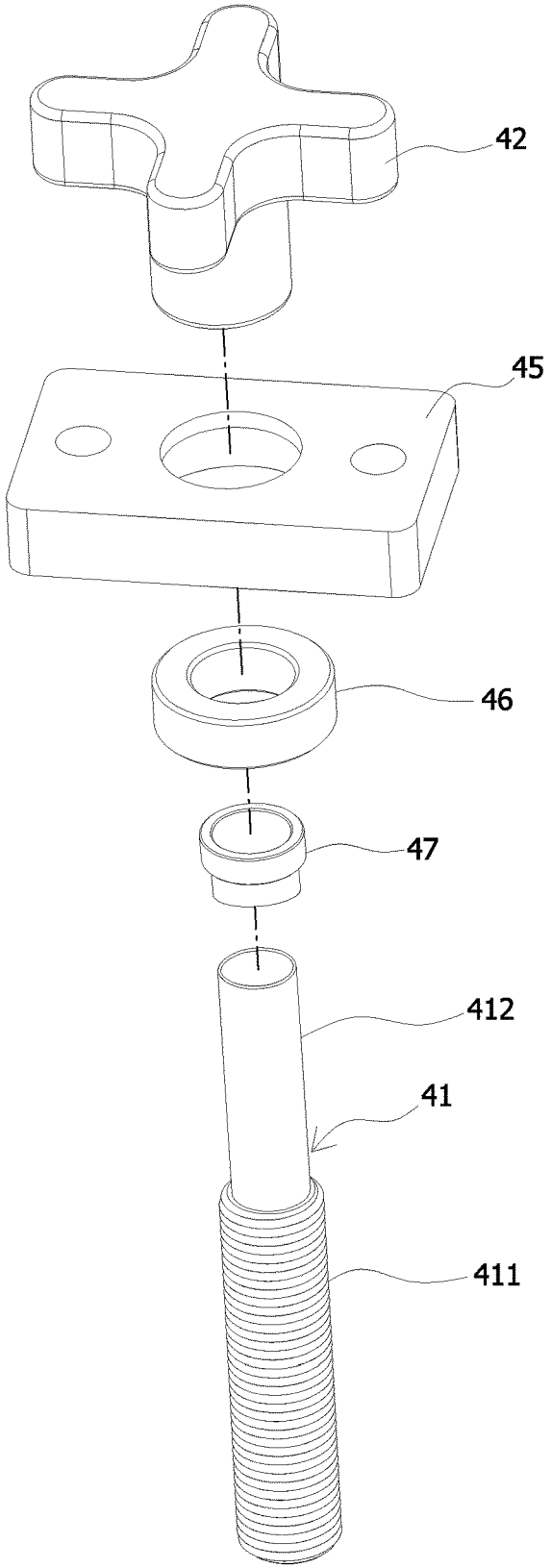
FIG. 5 is an exploded perspective view of the adjusting device in the present invention.
Figure 6:
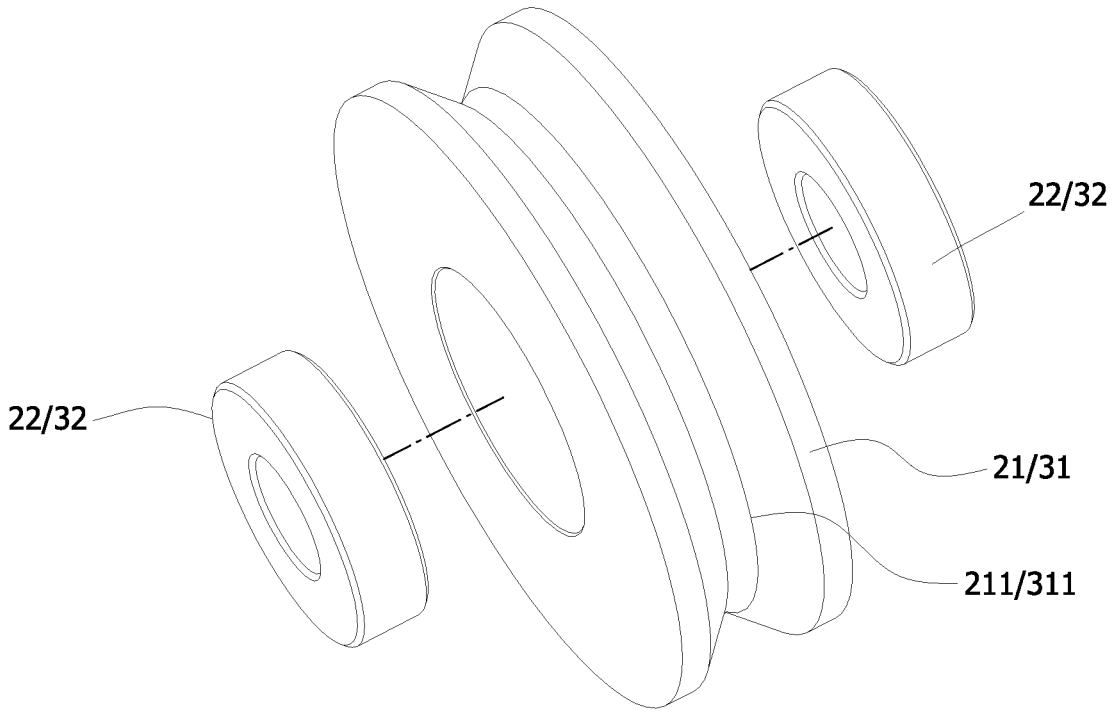
FIG. 6 is an assembly view of the lower pulley/upper pulley in the present invention.

Depicted in FIGS. 1-6 is an irregular tube straightener, which comprises a machine frame 1, an upper pulley block 2, a lower pulley block 3, and an adjusting device 4.

The upper pulley block 2 and the lower pulley block 3 are configured on the front side of the machine frame 1 and work together to reshape the irregular tube. Specifically, the upper pulley block 2 is located above the lower pulley block 3, and a gap is formed between the upper pulley block 2 and the lower pulley block 3 for the irregular tube to pass through. The upper pulley block 2 and the lower pulley block 3 clamps the irregular tube passing through the gap, so as to reshape the irregular tube, and then straighten the irregular tube.

The upper pulley block 2 comprises at least two upper pulleys 21. The upper pulley 21 is configured with a first bearing 22. The first bearing 22 is fitted with a first rivet 23. The first rivet 23 goes through the vertical slide opening 101 configured on the machine frame 1 and is fixed on the front face of the lifting and lowering seat 43 of the adjusting device 4, so that the upper pulley 21 is mounted on the lifting and lowering seat 43 of the adjusting device 4. When the lifting and lowering seat 43 is being lifted or lowered, the upper pulley block 2 will rise or descend along with the lifting and lowering seat 43, so as to adjust the size of the gap between the upper pulley block 2 and the lower pulley block 3 to meet the requirement for reshaping irregular tubes of different sizes.

The lower pulley block 3 comprises at least two lower pulleys 31. The lower pulley 31 is configured with two third bearings 32. The two third bearings 32 are fitted with second rivets 33. The second rivets 33 are fixed on the front face of the machine frame 1, so that the lower pulley block 3 is mounted stably on the front face of the machine frame 1. Furthermore, the end of the second rivet 33 fixed on the machine frame 1 is configured as a polygonal structure, so that the second rivet 33 can be riveted with the machine frame 1 more stably, avoiding rotation of the second rivet 33 and maintaining stability of the assembled structure.

In the present embodiment, the number of lower pulleys 31 is three. They are distributed at intervals, and are located on the same horizontal level. The number of upper pulleys 21 is two. They are distributed at intervals, and are located on the same horizontal level. In particular, the first upper pulley 21 is located above the gap between the first lower pulley 31 and the second lower pulley 31, the second upper pulley 21 is located above the gap between the second lower pulley 31 and the third lower pulley 31. In other words, the upper pulley 21 and the lower pulley 31 are staggered, so as to reshape the irregular tube, and then to straighten the irregular tube.

The periphery of the upper pulley 21 is configured with concave first groove 211 to contact the irregular tube. The periphery of the lower pulley 31 is configured with concave second groove 311 to contact the irregular tube. The second groove 311 is located below the first groove 211. The first groove 211 and the second groove 311 respectively contact with the upper and lower end face of the irregular tube, so as to reshape the irregular tube and then straighten the irregular tube. In this way, the quality of the final product can be guaranteed.

Further, the first groove 211 and the second groove 311 are both in the shape of V or U. The first groove 211 and the second groove 311 are both in the shape of V.

The adjusting device 4 is mounted on the machine frame 1, and can adjust the size of the gap between the upper pulley block 2 and the lower pulley block 3. Below are detailed descriptions of the structure of the adjusting device 4:

The adjusting device 4 comprises an adjusting screw rod 41 mounted on the machine frame 1 in a rotary form, a handle 42 fixed on the top end of the adjusting screw rod 41, a lifting and lowering seat 43 configured on the back side of the machine frame 1, a threaded bushing 44 fixed inside the lifting and lowering seat 43. The threaded section 411 on the lower end of the adjusting screw rod 41 is screwed inside the threaded bushing 44. The first rivet 23 goes through the vertical slide opening 101 configured on the machine frame 1 and is fixed on the front face of the lifting and lowering seat 43, so that the upper pulley 21 is mounted on the lifting and lowering seat 43. During operation of the adjusting device 4, the operator grips the handle 42 and turns the handle 42 to drive the adjusting screw rod 41 to rotate. At this time, the adjusting screw rod 41 will not be displaced. It can only be turned. By driving the adjusting screw rod 41 on the lower end of the threaded bushing 44 rise or descend, it will drive the lifting and lowering seat 43 to be lifted or lowered, and subsequently drive the upper pulley block 2 to rise or descend in relation to the lower pulley block 3. In this way, the gap between the upper pulley block 2 and the lower pulley block 3 can be adjusted to meet the need to reshape irregular tubes of different sizes.

Further, the adjusting device 4 also includes a bearing seat 45 fixed on the upper end of the machine frame 1, and a second bearing 46 mounted inside the bearing seat 45. The unthreaded rod section 412 on the upper end of the adjusting screw rod 41 is fixed inside the through hole of the second bearing 46 through the sleeve bushing 47, so as to ensure fixed installation of the adjusting screw rod 41 and the second bearing 46, and the unthreaded rod section 412 is extended out of the upper end face of the bearing seat 45. The handle 42 is fixed on the upper end of the unthreaded rod section 412. When turning the handle 42, the adjusting screw rod 41 will be driven to swivel. That is to say, the adjusting screw rod 41 will not be displaced. It can only rotate.

The lower end of the handle 42 is configured with a mounting slot. The handle 42 is fitted on the upper end of the unthreaded rod section 412 through the mounting slot. The outside of the lower end of the handle 42 is configured with a screw hole 421 communicated to the mounting slot. The screw hole 421 is spirally installed with a worm screw 422. The end portion of the worm screw 422 is embedded into the positioning slot configured outside the upper end of the unthreaded rod section 412, so as to ensure that the handle 42 is stably mounted on the top end of the adjusting screw rod 41, and avoid rotation of the handle 42 in relation to the adjusting screw rod 41.

The machine frame 1 comprises a vertical board 11 and a top board 12 formed by 90-degree folding on the upper end of the vertical board 11. The adjusting device 4 is located on the top board 12 and the handle 42 is exposed on the upper end of the top board 12.

The junction between the top board 12 and the vertical board 11 is integrally formed with reinforcing ribs 113 to increase the strength, so as to ensure that the top board 12 is stably fixed on the top end of the vertical board 11, and to ensure the structural strength of the whole machine frame 1. The surface of the vertical board 11 is stamped with bar-shaped convex ribs 114 to increase the strength, so as to ensure the rigidity of the vertical board 11, and to avoid curving and deforming of the vertical board 11. Thus, the overall service life can be longer.

The two sides of the lower end of the vertical board 11 are respectively configured with symmetrically distributed first L frame 15 and second L frame 16, to facilitate installation of the machine frame 1 and to provide convenience for usage. When the machine frame 1 is inserted into and installed on a machine base, the first L frame 15 and second L frame 16 can avoid too deep insertion of the machine frame 1, thus ensuring stabler installation of the machine frame 1 on the machine base.

In summary, the present invention uses an upper pulley block 2 and a lower pulley block 3 to clamp the irregular tube going through the gap between the upper pulley block 2 and the lower pulley block 3, so as to reshape the irregular tube. By turning the handle 42 inside the adjusting device 4, the size of the gap between the upper pulley block 2 and the lower pulley block 3 can be adjusted. The operation is very convenient. The simple structure means lower production cost, and the small overall size means easier transportation. Therefore, the invention will be very competitive in the market.

I claim:

1. An irregular tube straightener, comprising:

a machine frame (1), a front side of the machine frame (1) including an upper pulley block (2) and a lower pulley block (3) that work together to reshape an irregular tube, and an adjusting device (4) mounted on the machine frame (1) to adjust the size of a gap between the upper pulley block (2) and the lower pulley block (3), wherein the adjusting device (4) includes an adjusting screw rod (41) mounted on the machine frame (1) in a rotary form, a handle (42) fixed on an upper end of the adjusting screw rod (41), a lifting and lowering seat (43) configured on a back side of the machine frame (1), and a threaded bushing (44) fixed inside the lifting and lowering seat (43), a threaded section (411) on a lower end of the adjusting screw rod (41) is screwed inside the threaded bushing (44), the upper pulley block (2) includes at least two upper pulleys (21), and each of the at least two upper pulley (21) is configured with a first bearing (22), the first bearing (22) is fixed with a first rivet (23), the first rivet (23) goes through a vertical slide opening (101) configured on the machine frame (1) and is fixed on a front face of the lifting and lowering seat (43), so that the upper pulley (21) is mounted on the lifting and lowering seat (43).

2. The irregular tube straightener defined in claim 1, wherein the lower pulley block (3) includes at least two lower pulleys (31), and each of the at least two lower pulleys (31) is configured with two third bearings (32), the two third bearings (32) are fitted with second rivets (33), and the second rivets (33) are riveted on a front face of the machine frame (1).

3. The irregular tube straightener defined in claim 2, wherein an end of the second rivet (33) riveted on the machine frame (1) is configured as a polygonal structure.

4. The irregular tube straightener defined in claim 2, wherein the periphery of the upper pulley (21) is configured with a concave first groove (211) used to contact with the irregular tube, the periphery of the lower pulley (31) is configured with a concave second groove (311) used to contact with the irregular tube, and the second groove (311) is located below the first groove (211).

5. The irregular tube straightener defined in claim 4, wherein the first groove (211) and the second groove (311) are both in the shape of V or U.

6. The irregular tube straightener defined in claim 1, wherein the adjusting device (4) also includes a bearing seat (45) fixed on the upper end of the machine frame (1) and a second bearing (46) mounted inside the bearing seat (45), an unthreaded rod section (412) on the upper end of the adjusting screw rod (4) goes through the sleeve bushing (47) and is fixed inside the through hole of the second bearing (46), the unthreaded rod section (412) is extended out of the upper end face of the bearing seat (45), and the handle (42) is fixed on the upper end of the unthreaded rod section (412).

7. The irregular tube straightener defined in claim 6, wherein the lower end of the handle (42) is configured with a mounting slot, the handle (42) is fitted on the upper end of the unthreaded rod section (412) through the mounting slot, and the outside of the lower end of the handle (42) is configured with a screw hole (421) that is communicated to the mounting slot, the screw hole (421) is spirally fitted with a worm screw (422), and the end portion of the worm screw (422) is embedded into the positioning slot configured on the periphery of the upper end of the unthreaded rod section (412).

8. The irregular tube straightener defined in claim 1, wherein the machine frame (1) comprises a vertical board (11) and a top board (12) formed through 90-degree folding on one side of the upper end of the vertical board (11), the adjusting device (4) is configured on the top board (12), and the handle (42) is exposed on the upper end of the top board (12).

9. The irregular tube straightener defined in claim 8, wherein the junction between the top board (12) and the vertical board (11) is integrally formed with reinforcing ribs (113) to increase the strength, and the surface of the vertical board (11) is stamped with bar-shaped convex ribs (114) to increase the strength.

10. The irregular tube straightener defined in claim 9, wherein the two sides of the lower end of the vertical board (11) are respectively configured with symmetrically distributed first L frame (15) and second L frame (16).

* * * * *